US005551851A

United States Patent [19]

Williams et al.

[11] Patent Number: 5,551,851

[45] Date of Patent: Sep. 3, 1996

[54] SCROLL COMPRESSOR CONSTRUCTION AND METHOD OF ASSEMBLY

[75] Inventors: John R. Williams; Scott A. Schultz, both of Bristol; Terry L. Lyons, Blountville, all of Tenn.

[73] Assignee: Bristol Compressors, Inc., Bristol, Va.

[21] Appl. No.: 385,996

[22] Filed: Feb. 3, 1995

[51] Int. Cl.[6] ..... F04C 18/04

[52] U.S. Cl. ..... 418/55.1; 418/55.5; 418/57; 29/888.022

[58] Field of Search ..... 418/55.1, 57, 55.5; 29/888.022

[56] References Cited

U.S. PATENT DOCUMENTS 3,924,977 12/1975 McCullough ..... 418/57

4,552,517 11/1985 Shimizu ..... 418/55.1

*Primary Examiner*—John J. Vrablik

[57] ABSTRACT

A scroll compressor having a housing containing a non-orbiting scroll and an orbiting scroll and a crankshaft having an eccentric mounted on the orbiting scroll, the non-orbiting scroll being fixed in operative position on the housing by a plurality of pairs of cooperating, mating key and keyway type components provided on the housing and non-orbiting scroll and mating with predesigned pressure contact, wherein all of the pairs have been mated with substantially equal pressure contact prior to fixing the positions of the pairs on the housing, and wherein the mated pairs allow axial compliance motion of the non-orbiting scroll while providing predetermined resistance to the motion.

20 Claims, 6 Drawing Sheets

SCROLL COMPRESSOR CONSTRUCTION AND METHOD OF ASSEMBLY

FIELD OF INVENTION

This invention concerns scroll compressors and particularly concerns novel structure of the non-orbiting scroll and of the mounting structure therefor on the compressor housing, and the method for assembling the scroll to the housing.

BACKGROUND OF THE INVENTION

In scroll compressors wherein the non-orbiting scroll must be assembled in the compressor housing in a particular geometric relationship to the longitudinal axis of the compressor e.g., where the center axis of said scroll must be in alignment with the axis of the bore formed in a portion of the compressor housing and in which the axial section of the crankshaft is mounted, substantial difficulty is typically encountered in locating and permanently securing the scroll in such alignment. In situations where the scroll must be allowed to move axially for achieving axial compliance, and particularly where it is desired to mechanically restrain, to a desired degree, separation of the scrolls during operation of the compressor, hereinafter "controlled axial compliance motion", the alignment problem is greatly magnified, particularly in regard to providing for such axial motion without allowing radial or angular dislocation of said scroll with attendant loss in proper wrap flank sealing and compressor efficiency. In this regard it is noted that the high gas pressures developed between the scroll wraps during compressor operation exert large forces laterally against the wraps, which forces, without adequate restraining structure, would force the scroll laterally away from its axial alignment.

DISCUSSION OF PRIOR ART

Heretofore, various mechanisms and methods have been proposed for achieving and maintaining the aforesaid alignment such as disclosed, for example, in U.S. Pat. No. 5,102,316, however, none of such mechanisms provides a means for allowing axial compliance motion of the scroll with essentially zero allowance for lateral, i.e., radial and/or angular motion thereof, particularly while providing a predetermined restraining force for inhibiting axial separation of the scrolls. In this regard, these prior mechanisms rely on close machining tolerances to position and maintain the position of the non-orbiting scroll. It is the need for such close tolerances which literally prevent a truly accurate maintenance of the aforesaid alignment while allowing controlled axial compliance motion of the scroll.

OBJECTS OF THE INVENTION

Objects, therefore, of the present invention are: to provide an alignment means for mounting and affixing a non-orbiting scroll on a compressor housing whereby controlled axial compliance motion of the scroll is accommodated but essentially zero radial or angular motion thereof is allowed; to provide such alignment means with mating key and keyway type structures which can provide an essentially zero clearance aspect in the radial and angular directions; to provide such alignment means wherein at least one of said key or keyway structures is adjustable relative to the other, radially and/or angularly during assembly by automatic or semi-automatic means; to provide an embodiment of such alignment means which does not rely upon close machining tolerances in order to achieve zero lateral motion of the scroll; to provide such alignment means which is readily adjustable both radially and/or angularly for providing essentially zero clearance while providing for desired controlled axial compliance motion of the scroll; to provide such alignment means in a scroll compressor wherein the base of the orbiting scroll is supported by a large bearing surface on said housing means whereby enhanced orbit accuracy with reference to the non-orbiting scroll is maintained; and to provide a method for facilitating the use of such alignment means in the assembly of a non-orbiting scroll in a compressor housing.

SUMMARY OF THE INVENTION

These and other objects hereinafter appearing have been attained in accordance with the present invention through the discovery of scroll compressor construction comprising housing means containing a non-orbiting, axially compliant scroll means having a center axis, and an orbiting scroll means also having said axis, said scrolls each having a base means having a center axis therethrough and a wrap extending axially outwardly therefrom, said wraps being in nested association and said axes being positioned in operative relationship, crankshaft means having an axial section and an eccentric section, said eccentric section being rotatably mounted on said orbiting scroll means for orbiting the same about its center axis and thereby generating a pressure continuum between said scrolls, main bearing means within and formed on said housing means and having a bore whose axis defines the longitudinal axis of said compressor, said axial section of said crankshaft being mounted for rotation in said bore, alignment means fixing the radial and angular positions of said non-orbiting scroll means on said housing means with its center axis and said longitudinal axis in alignment and providing a predetermined force to said scroll means for resisting any tendency for axial separation movement thereof caused by pressures developed in said pressure continuum, said alignment means having a plurality of first components angularly spaced on and supported by said non-orbiting scroll means, and a plurality of second components angularly spaced on and supported by said housing means, each of said first components being adapted to frictionally engage one each of said second components to provide a plurality of mating component pairs, adjustment means on at least one of said first or second components for rendering that component at least radially, position adjustable with respect to the other component of its pair, and hold-down means locking each said position adjustable component to its support in an immovable position, said alignment means, during operation, allowing axial compliant, separating movement of said non-orbiting scroll means only in response to predetermined pressures developed in said pressure continuum.

In certain preferred embodiments:

(a) said components comprise key means mounted on support means provided therefor on said housing means, and keyway means formed on support means provided therefor on said non-orbiting scroll means;

(b) said base means of said non-orbiting scroll means is provided with substantially axially depending skirt means; having axially outer first support means, and said keyway means are formed in said support means, and said key means are mounted on axially outer second support means provided on a substantially axially extending stationary rim means provided on said housing means;

(c) said second support means is provided with substantially planar surface means which lie in a plane which is oriented substantially normally to said longitudinal axis, and wherein at least one of said key means is provided with said adjustment means and is laterally adjustably, slidably mounted on said surface means;

(d) at least one of said components is laterally adjustable in all directions on its support means within a lockdown plane which is oriented substantially normally to said longitudinal axis;

(e) said key means is the adjustable element of the pair, wherein said hold-down means comprises bolt means passing generally axially through hole means formed in said key means and threaded into said housing means, and wherein said hole means is from about 0,004 in. to about 0.1 in. larger in diameter than the diameter of the shank of said bolt means; and (f) the alignment of the non-orbiting scroll and its permanent placement is defined as the method for setting and fixing the radial position of a non-orbiting scroll with respect to the longitudinal axis of a scroll compressor having a housing means, comprising the steps of:

(1) establishing the longitudinal axis of said compressor by providing main crankshaft bearing means in said housing means, the axis of the bore of said bearing means providing said longitudinal axis;

(2) providing, prior to or subsequent to step (1), at least two generally angularly opposed stop means on each of said housing means and said scroll, said stop means being angularly spaced from each other around said longitudinal axis, said angular spacing being designed to allow the positioning of each stop means on said housing means in juxtaposition to a mating stop means on said scroll to provide at least two pairs of juxtaposed mating stop means upon placement of said scroll on said housing means in a desired operating position with respect to said longitudinal axis, at least one of said stop means on at least one of said pairs being at least radially adjustable;

(3) placing said scroll in said desired operating position relative to said longitudinal axis with said stop means of each said pair substantially in juxtaposition;

(4) moving each said adjustable stop means into pressure contact with its mating stop means; and (5) locking each said adjustable stop means in a fixed position on its support to thereby maintain said pressure contact and allow only axial motion of said scroll relative to said housing and to provide a predesigned resistance to said axial motion.

BRIEF DESCRIPTION OF THE DRAWINGS

The invention will be further understood from the drawings herein and description thereof of certain preferred embodiments, wherein.

Figure 1:
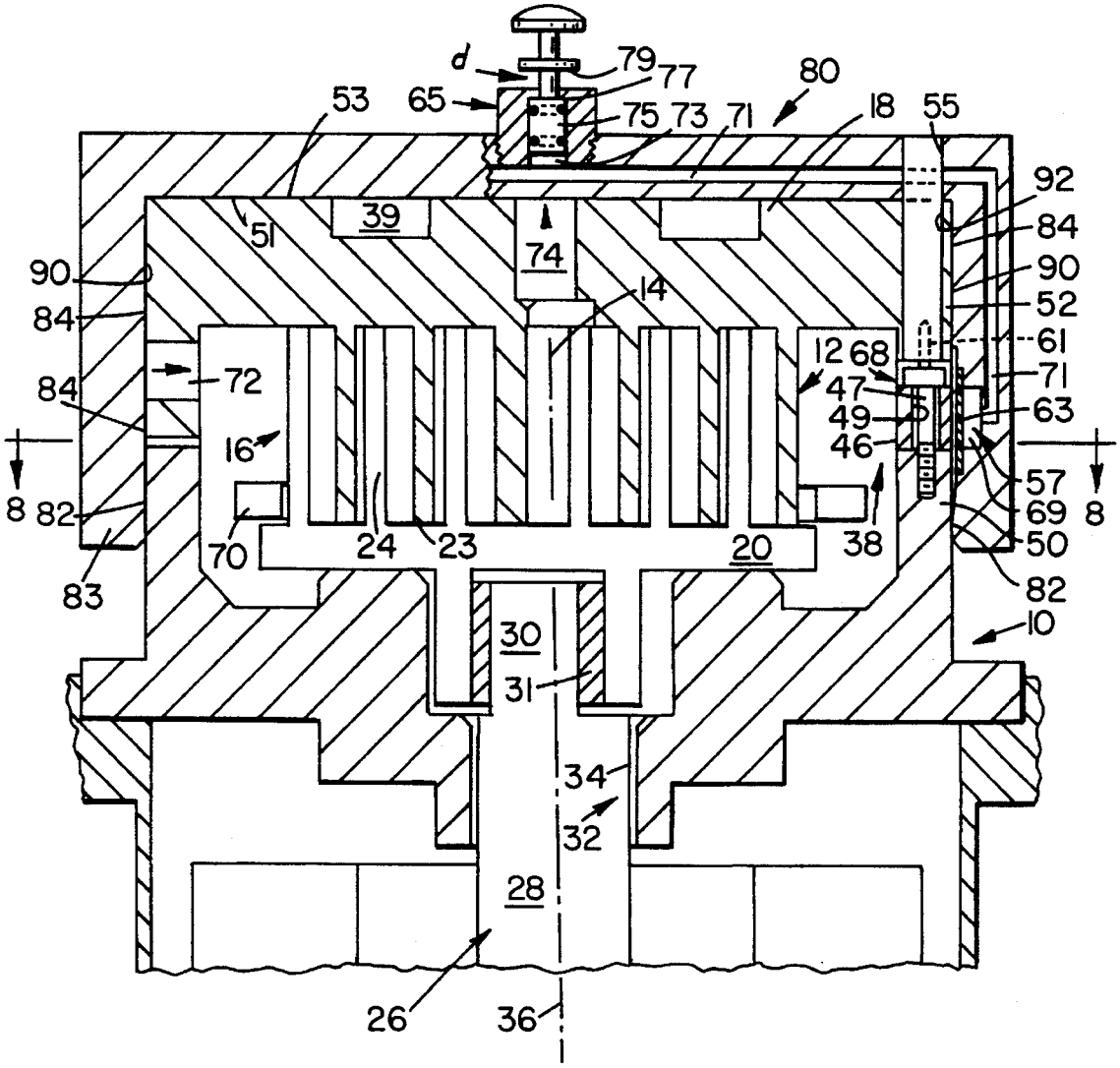
FIG. 1 is a longitudinal cross-sectional view of the scroll section of a scroll compressor taken along line 1—1 of FIG. 2 in the direction of the arrows, embodying the present invention and showing portions of a scroll positioning and assembly device in place on said section.

Referring to the drawings, and with particular reference to the claims hereof, the present compressor comprises housing means 10 containing a non-orbiting scroll 12 having a center axis 14 and an orbiting scroll 16 having a center axis 15, said scrolls having base means 18, 20 respectively and wraps 22, 24 respectively extending axially outwardly therefrom and terminating in tips 23, 25 respectively, said wraps being in nested operative association and said axes being positioned in cooperative relationship, crankshaft means 26 having an axial section 28 and an eccentric section 30, said eccentric section being rotatably mounted on said orbiting scroll in bushing 31 for orbiting the same about its center axis and generating a pressure continuum 21 between said scrolls, i.e.. pressure pockets which are continually formed, compressed, discharged and reformed, main bearing means 32 within and formed on said housing means and having a bore means 34 whose axis 36 also defines the longitudinal axis of said compressor, said axial section of said crankshaft being mounted for rotation in said bore means, alignment means generally designated 38 fixing the radial position 40 and angular position 42 of said non-orbiting scroll (see FIG. 2) on said housing means with its center axis and said longitudinal axis 36 in alignment, said alignment means 38 having a plurality, i.e., at least two and preferably about 3–6 pairs 44 of cooperating positioning components comprising, in a preferred embodiment, key means or blocks 46 and keyway means or blocks 48, said pairs being angularly spaced about said longitudinal axis, preferably symmetrically with one of said components being mounted on said housing means and the other of said components being mounted on said non-orbiting scroll means on support means 50, 52 respectively thereon, one of said key means or said keyway means of at least one said pair being laterally position adjustable on its support means, said key means and said keyway means preferably having cooperating, juxtaposed generally wedge-shaped surfaces 54, 56 respectively having axially oriented surface components such as 58. 60 respectively and generally radially directed components such as 62, 64 respectively, the latter of which components converge in a direction 66 generally toward said longitudinal axis, and hold-down means 68 locking said adjustable key means or keyway means to its support means in an immovable position, said alignment means allowing essentially only axial movement of said non-orbiting scroll relative to said longitudinal axis while providing resistance force to said axial movement. The construction and shapes of said components can be widely varied as will hereinafter become evident, however, the aforesaid wedge configuration for the laterally adjustable component, e.g., wedge shaped key means, and its cooperating component is preferred.

The general construction of the compressor such as its housing or shell, motor, scroll wrap configuration, radial compliance structure, axial compliance mechanism, e.g., a pressure chamber and seal unit such as indicated by 37 herein for providing an axial compliance pressure surface 35 exposed to discharge pressures, Oldham coupling, e.g.. item 70 in FIG. 1, and inlet and outlet porting 72, 74 may be as shown or alternatively, of conventional or well known construction and location such as shown in the scroll compressor art exemplified by U.S. Pat. Nos. 5,102,316; 4,609,334; 4,954,057; 5,011,384; 5,017,107; 4,954,057; 4,877,382; 4,767,293; 3,874,827; 5,037,279; 5,056,336; 5,295,813; 4,609,334; 5,088,906; 4,938,669; 5,085,565; 5,082,432; 4,892,469; 5,129,798; and 4,600,369, the disclosures of which regarding the aforesaid conventional or well known construction are hereby incorporated herein by reference.

Figure 2:
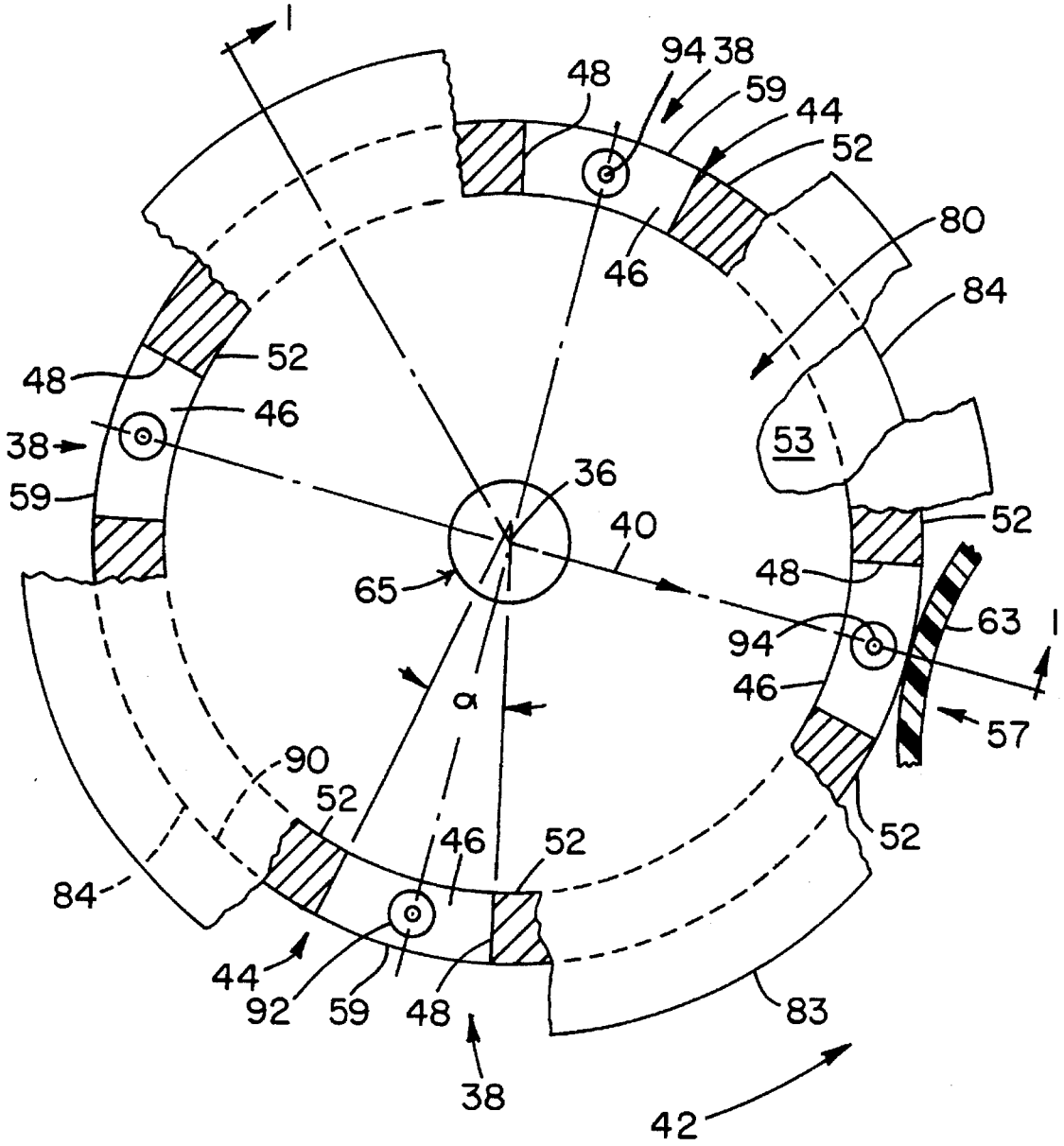
FIG. 2 is a top elevational view of the compressor and assembly device of FIG. 1 with certain portions enlarged for clarity, and certain portions broken away for clarity.
Figure 3:
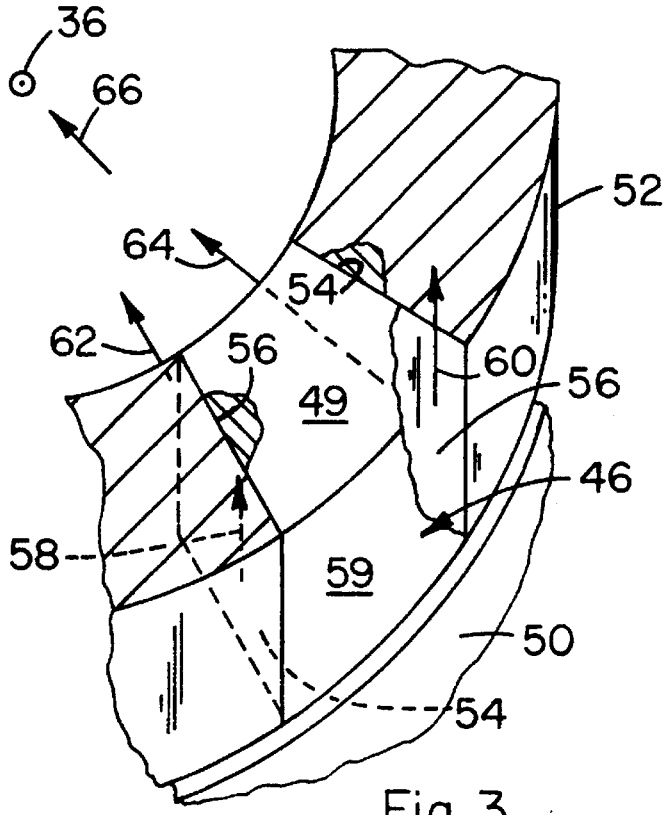
FIG. 3 is an isometric view of the key and keyway area with support means 52 cut off at the top plane of the key means 46.
Figure 4:
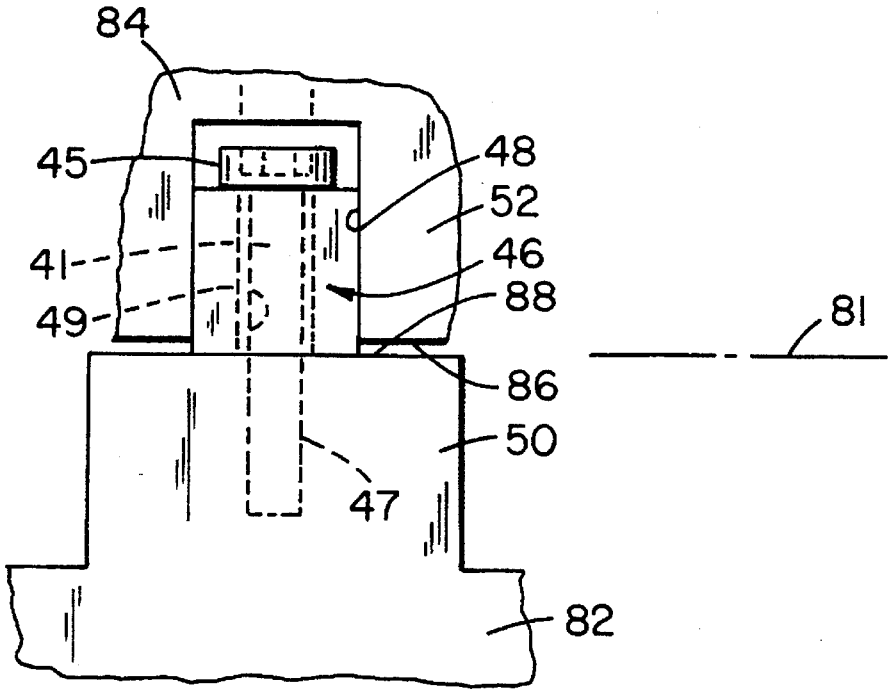
FIG. 4 is a side view of the key and keyway area.
Figure 5:
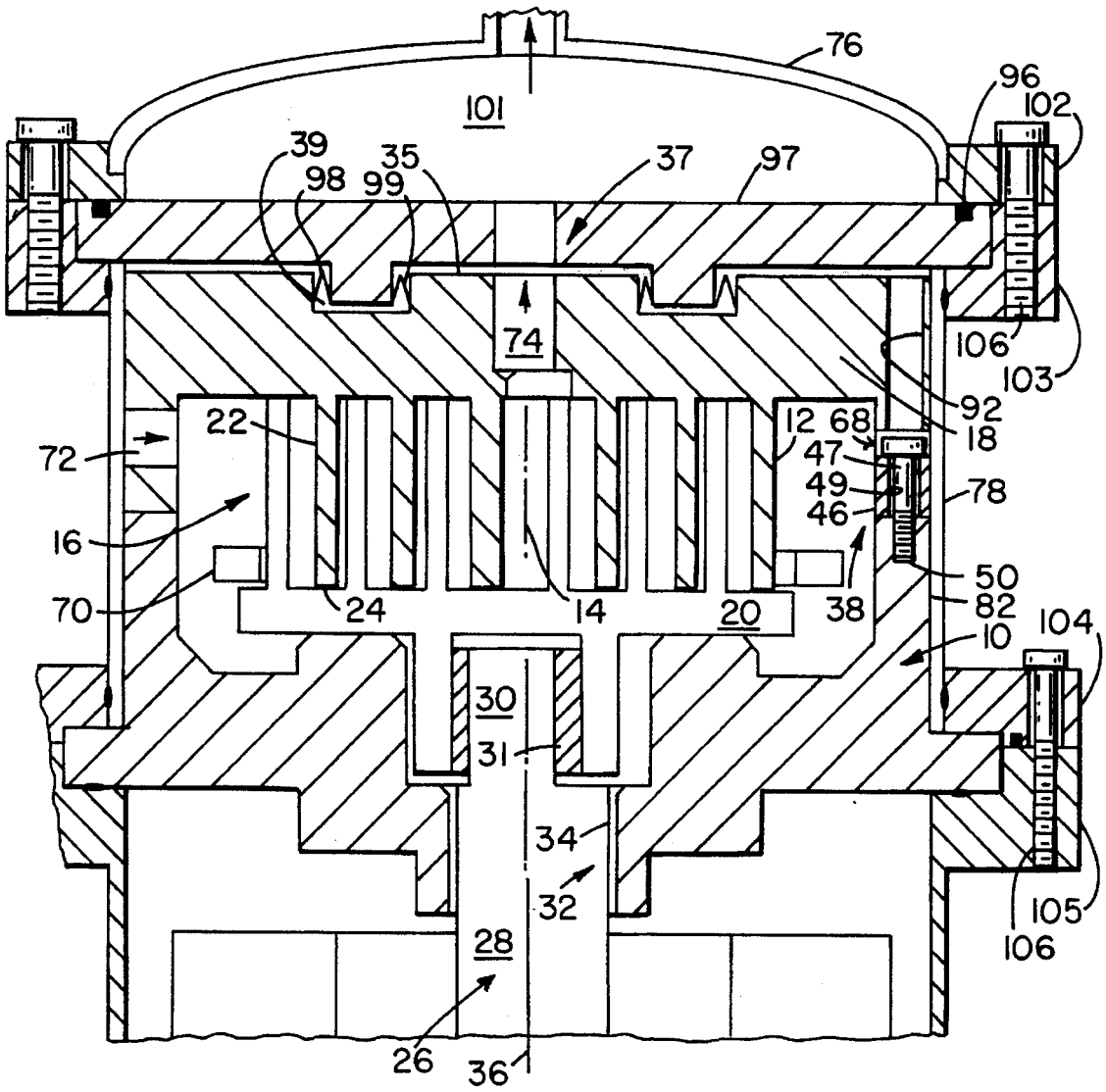
FIG. 5 is a longitudinal cross-sectional view as in FIG. 1 with the scrolls in final assembled position and with the axial compliance mechanism and discharge chamber cap and scroll side cover in place.

Referring to FIGS. 1 and 2 which show an embodiment of an assembly device which can be employed for obtaining the desired alignment and axial compliance resistance force, the discharge chamber cap 76 and scroll side cover 78 of the assembled compressor unit of FIG. 5 have not yet been affixed to the compressor, and said assembly device generally designated 80 is shown in position where it has been precisely positioned with respect to the center axis 14 of the non-orbiting scroll and with respect to housing means 10 and the longitudinal axis 36. This positioning results from the prior, accurate locating and machining of certain parts of the housing means 10, bearing means 32, outer peripheral wall 82 of support means 50, outer peripheral wall 84 of scroll base means 18, and inner wall 90 of assembly device 80. In FIG. 2, portions of the assembly device and the scroll have been broken away to clearly show the key means in their inwardly forced positions by diaphragm means such as shown by the enlarged 63, which key means are ready to be locked down to support 50 on the housing means.

In carrying out this machining for the purpose of employing the particular aligning means and assembly device shown, walls 82 and 84 are machined to render them concentric with axis 36 and of the same diameter such that the center axis of both scrolls are aligned when walls 82 and 84 are in axial alignment. It is noted that such carefully machined surfaces also provide reference points for the use of electronic locating devices which employ pressure sensitive probes or the like for indicating in which direction the scroll must be moved to get perfect alignment. The key means 46 and locking screws 47, both well lubricated, are then placed on support means 50 in the approximate position shown in the drawings wherein the screws 47 are only loosely held in their support means and the key means are perfectly able to move freely within the limits afforded by the larger diameter screw holes 49 provided in the key means. It is noted that these screws holes are sufficiently large to allow easy mating of the key means and keyway means during assembly and to allow development of the desired subsequent pressure contact of their juxtaposed wedge-shaped surfaces.

In this regard, it is noted that axially outer edges 86 and 88 respectively of scroll wall 84 and housing support means 50 are spaced apart, e.g., 0.050 in. during the assembly procedure by way of the wrap tips bottoming out on the adjacent scroll bases. In regard to the proper angular and radial positioning of the non-orbiting scroll, such is accomplished, at least in part, by making screw holes 49 just enough larger in diameter than the shank 41 of screws 47 as to allow keys 46 to be moved radially and angularly into pressure contact with the sides of the keyways 48. With proper machining of the keys and keyways, only a few thousandths of an inch difference in diameters is necessary, particularly since the present assembly device will further adjust both angular and radial positioning of scroll 12 and the critical housing portions.

Scroll 12 is then placed in nested arrangement with the orbiting scroll with edges 86, 88 maintained with proper clearance and with proper axial attitude of the non-orbiting scroll achieved by the aforesaid contact of the wrap tips and scroll bases. This placement of scroll 12 properly positions access holes 92 of base means 18, essentially in alignment with the axis of locking screws 47. Holes 92 preferably are at the angular center 94 of the keyway means 48. The assembly device, the inner wall 90 of which has been carefully machined, e.g., to a diameter of about 0.001 in. or less larger in diameter than the diameter of walls 82, 84, is then carefully placed, with adequate lubrication, down over walls 82 and 84, preferably until the inner top surface 51 thereof bears against the free surface 53 of the non-orbiting scroll base, and whereby screw access holes 55 in the device are aligned with holes 92 in said base. At this position, a force generating unit generally designated 57 lies adjacent the outer surface 59 of each adjustable component, e.g., key means and is adapted to simultaneously contact and force each key means into a position such as shown in FIG. 2 wherein the wedge shaped surfaces 54 and 56 of all the adjustable key means and keyway means respectively are in contact at a predesigned force which allows only relative axial sliding movement between said surfaces, and with predetermined resistance to said movement by virtue of the force applied by said unit 57, for allowing axial compliance movement at a predetermined minimum pressure in the pressure continuum. The screws 47, preferably Allen screws, are then carefully tightened to a desired torque by a suitable tool, e.g., a torque wrench fitted Allen wrench 61 inserted through holes 55, 92 and into the hex socket or the like in the screw head 45.

The force generating means or units 57 can be of any type and construction, the type shown comprising a flexible diaphragm 63, which may be rectangular, circular or other shape and which is secured and sealed completely around its edges 65 to the inner wall 90 of depending flange or skirt 83 of assembly device 80, and recessed therein such that it will not interfere with the sliding of said flange or skirt down over walls 82 and 84. This diaphragm may be associated with a piston of metal, plastic, or the like, or a piston/cylinder arrangement may be used by itself. In regard to the diaphragm and with reference to FIG. 8, the curvature of walls 82, 84 and 90 is compensated for by recessing diaphragm 63 sufficiently to place only its center portion 67 immediately adjacent outer surface 59 of the key means. This feature is preferred as it gives an almost point contact of the diaphragm with the key means which facilitates the application of a uniform force to all key means. The dimensions, configurations, materials of its manufacture, flexibility, resiliency, modulus of elasticity and the like of all of the diaphragms should be essentially identical such that equal and predesigned force can be applied simultaneously, if desired, to each key means.

The means for applying pressure to the diaphragms can be widely varied and can be physical, e.g., spring or weight urged, or can be pneumatic or hydraulic as shown in FIG. 1 wherein a pressure chamber 69 is provided for each diaphragm, said chambers all being connected by fluid transporting passage means 71 which are all in communication with a manifold or cylinder 73 within the assembly device. The pressure in chambers 69 can be provided by air or hydraulic fluid contained in chambers 69, passage means 71, and cylinder 73, as compressed by piston 75 of pressure unit 65. This piston, by means of shoulders 77 and 79 respectively on the cylinder bore and the piston plunger, can only deliver at its maximum travel, a set, predesigned volume of fluid to the diaphragms and thus provides a set, predesigned and equal force to the several key means. The size of piston 75 as shown is exemplary only, and a larger size would likely be required for providing pneumatic rather than hydraulic force. The force should be continuously applied during tightening of bolts 47 and thus a mechanism for maintaining depression of the piston during the tightening should be provided.

The force to be applied to the keys 46 at their outer surface 59 for achieving the desired frictional, pressure contact of the keys with the keyways will vary depending on, e.g., the wedge angle "α". Where the angle is small, too much force will cause jamming of the key in the keyway, and where the angle is large, considerable force can be applied. For the included angle of about 30° shown in FIG. 2, a pressure of from about 0.5 to about 10.0 psi would maintain proper axial alignment against the lateral forces developed during normal compressor operation. More or less pressure, however, e.g., up to about 300 psi or more can be applied as required to give a desired mechanical or frictional resistance to axial compliance motion of, e.g., 100 to 500 pounds.

The assembly device shown is principally of the physical or structural type and is not intended to exclude use of the more sophisticated means which may be employed for axially aligning the fixed scroll center axis with the longitudinal axis, such as the highly sensitive and highly accurate electro-mechanical devices employing, e.g., piezoelectric crystals having high sensitivity to pressure and located in probes which are associated with electronic amplifiers, servomotors, visual graphics, computer print-out devices or the like for actually moving the scroll physically into alignment or for following and reporting the progress or status of the alignment procedure. Nor is the device shown intended to exclude the use of hand applied pressure or hand operated pressure developing devices for applying the necessary force to the key means.

Referring to FIG. 5, the scroll side cover 78, axial compliance seal plate 97 with annular seal groove 39, double annular seals 98, 99, and cap 76 providing discharge chamber 101 are shown fixed in place and hermetically sealed and fastened by flanges 102, 103, 104 and 105 and annular seals 96 or the like and suitable machine screws or bolts such as 106.

Figure 7:
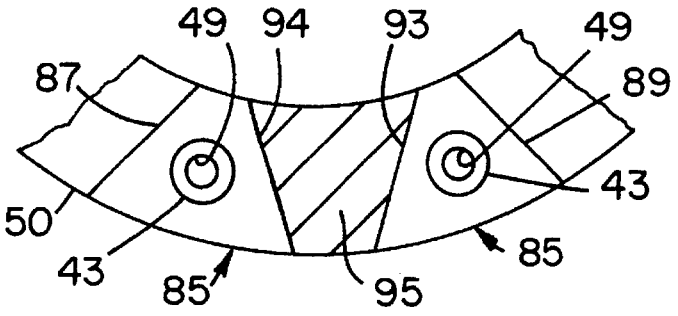
FIG. 7 is a cross-sectional view taken along line 7–7 of FIG. 6 in the direction of the arrows.
Figure 6:
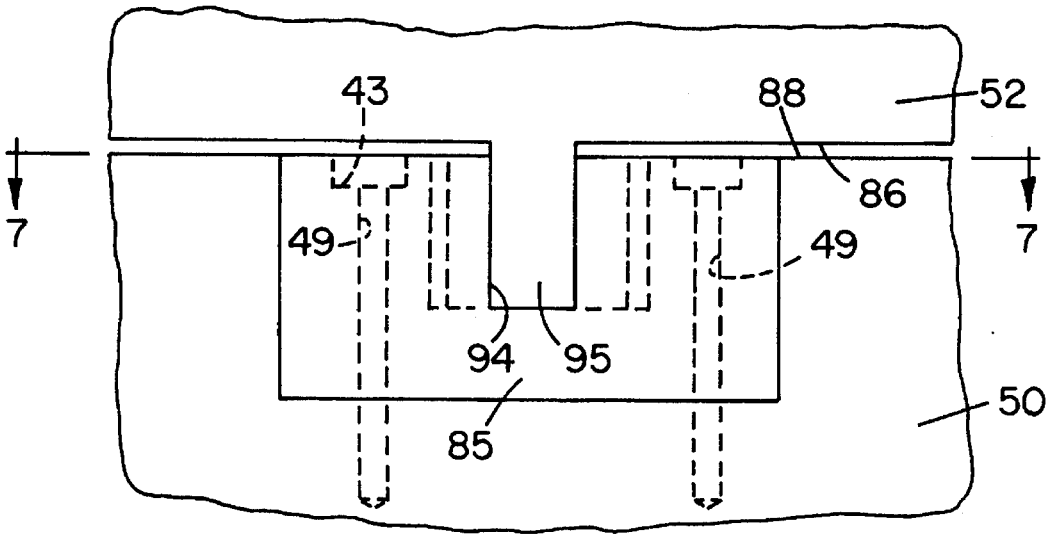
FIG. 6 is a side view of a variation of the structures of key and keyway components.

In the embodiment shown in FIG. 6 and 7, the previously described key means has been modified to the form of a keyway body generally designated 85 and having outer wedge surfaces 87, 89, and inner wedge surfaces 91, 93 formed therein, to provide a key shaped body which actually carries a wedge shaped keyway means 94. The key means 95 which fits into 94 is a permanent, fixed part of support means 52 on the non-orbiting scroll. Body 85 is provided with a pair of screw holes 49 and screw head recesses 43, and support means 52 and device 80 are provided, as aforedescribed, with the necessary screw access holes 92 and 55 respectively for accessing holes 49. Alternatively, holes 49 and recesses 43 may be provided in body 85 at the bottom of keyway means 94 such that access hole 92 will pass down through key means 95. The manner in which the assembly of the scroll of this embodiment is made, and the manner of using the assembly device is essentially as previously described.

Figure 8:
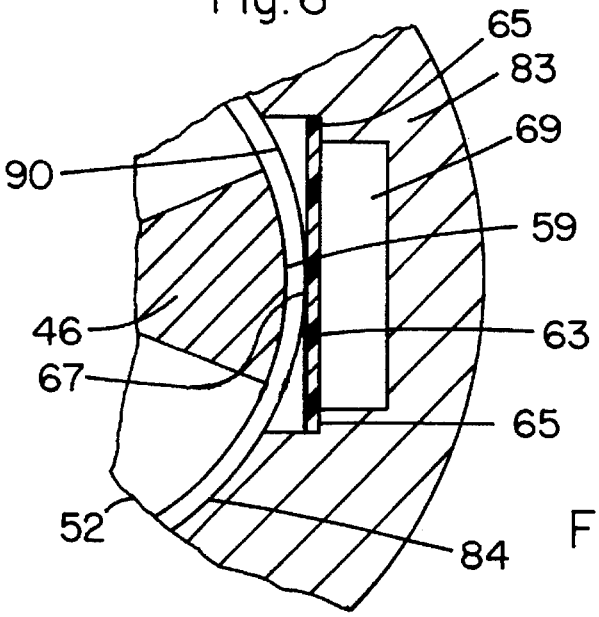
FIG. 8 is an enlarged cross-sectional view of the key/keyway area of the depending skirt of the assembly device taken along line 8–8 of FIG. 1 in the direction of the arrows.
Figure 9:
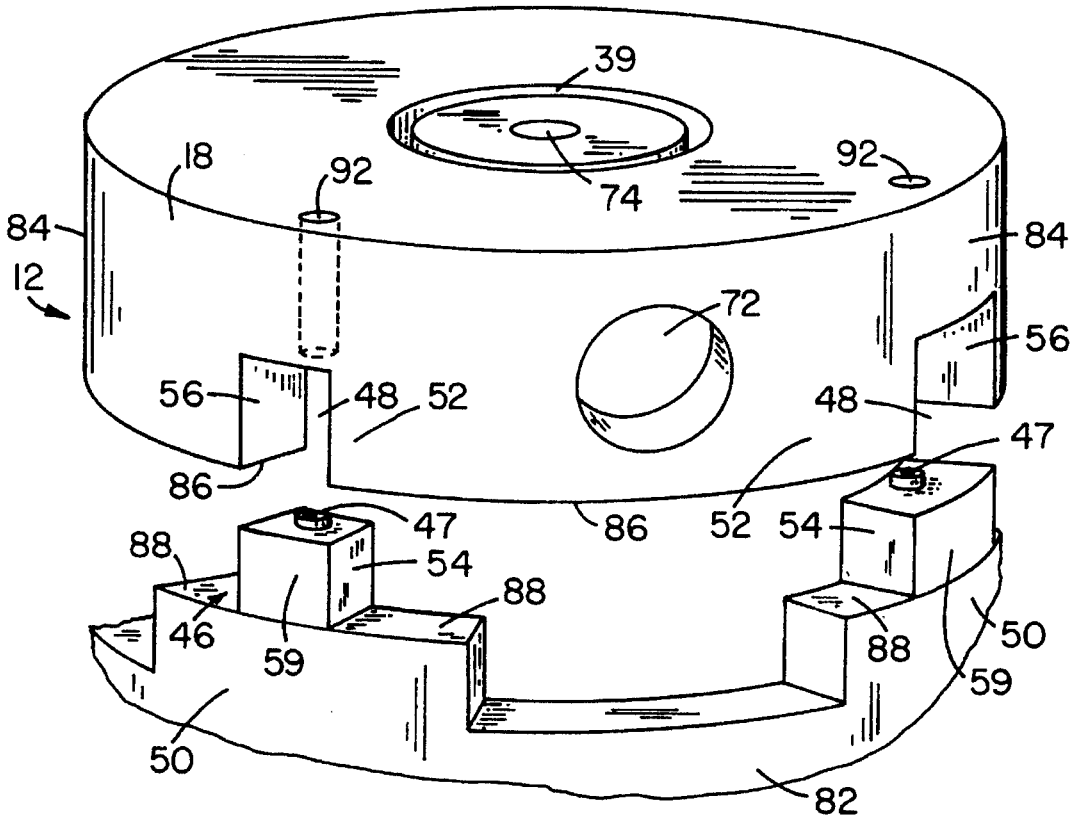
FIG. 9 is an isometric view of portions of the fixed scroll and key/keyway area as it will be seen during assembly.
Figure 10:
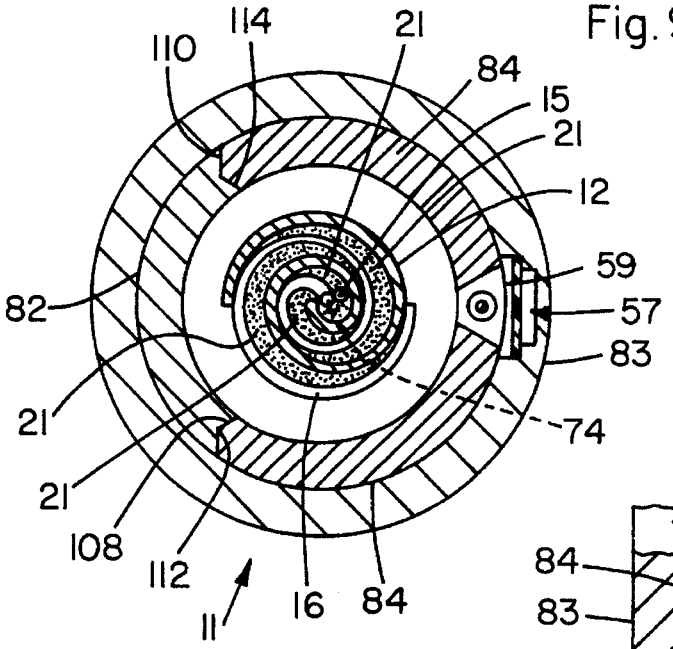
FIG. 10 is a cross-sectional view taken along aforesaid line 8—8 of FIG. 1 in the direction of the arrows showing a variation in the alignment means structure of FIG. 8.
Figure 11:
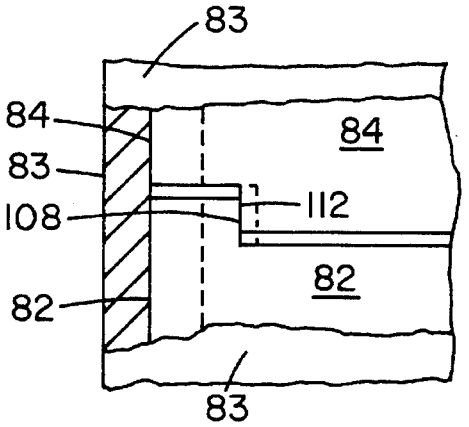
FIG. 11 is a view taken in the direction of arrow 11 in FIG. 10, with portions of the assembly device broken away to show a pair of alignment components.

With reference to FIGS. 10 and 11, the component pairs of the alignment means comprise a combination of non-adjustable and adjustable components. The pair which has the adjustable component is as shown in FIG. 8 and is numbered the same. The other two pairs are non-adjustable and comprise axially oriented shoulder or stop means 108, 110 integrally formed on the non-orbiting scroll wall 84, and axially oriented shoulder or stop means 112, 114 integrally formed on housing wall 82. These stop means are preferably shaped as shown and are machined within acceptable limits such that their mating will effect the desired alignment of the non-orbiting scroll with said longitudinal axis. Consequently, when the desired pressure or force is applied to outer surface 59 of the key means component and said component is then locked down, the three substantially symmetrically arranged pairs will maintain the required scroll alignment while allowing axial compliance movement thereof against a predesigned resistance.

The invention has been described in detail with particular reference to preferred embodiments thereof, but it will be understood that variations and modifications will be effected within The spirit and scope of the invention.

We claim:

1. A scroll compressor comprising housing means containing a non-orbiting, axially movable scroll means having a center axis, and an orbiting scroll means also having a center axis, each said scroll means having a base means and a wrap extending axially outwardly therefrom, said wraps being in nested association and said axes being spaced in operative relationship, crankshaft means having an axial section and an eccentric section, said eccentric section being rotatably mounted on said orbiting scroll means for orbiting the same about its center axis and thereby generating a pressure continuum between said scrolls, main bearing means within and formed on said housing means and having a bore whose axis defines the longitudinal axis of said compressor, said axial section of said crankshaft being mounted for rotation in said bore, alignment means fixing the radial and angular positions of said non-orbiting scroll means on said housing means with its center axis and said longitudinal axis in alignment and providing a predetermined force to said non-orbiting scroll means for resisting any tendency for axial separation movement thereof caused by pressures developed in said pressure continuum, said alignment means having a plurality of pairs of cooperating, scroll positioning first and second components, support means on each of said housing means and non-orbiting scroll means, said pairs being angularly spaced about said longitudinal axis, one component of each said pair being mounted or formed on said support means on said housing means and the other component of each said pair being mounted or formed on said support means on said non-orbiting scroll means, adjustment means on one component of at least one said pair rendering that component at least radially, position adjustable with respect to the other component of its pair, and hold-down means locking each said position adjustable component to its support means in an immovable position, said alignment means, during compressor operation, allowing axial compliance, separating movement of said non-orbiting scroll means only in response to predetermined pressures developed in said pressure continuum.

2. The compressor of claim 1 wherein at least one said pair comprises key means and keyway means having cooperating, juxtaposed generally wedge shaped surfaces having axially oriented surface components and generally radially directed surface components, the latter of which components converge in a direction generally toward said longitudinal axis, and wherein at least one of said key means is provided with said adjustment means.

3. The compressor of claim 2 wherein said key means are mounted on said support means on said housing means and said keyway means are formed on said support means on said non-orbiting scroll means.

4. The compressor of claim 1 wherein said base means of said non-orbiting scroll means is provided with substantially axially depending skirt means having axially outer first support means, and said keyway means are formed in said support means.

5. The compressor of claim 4 wherein said key means are mounted on axially outer second support means provided on substantially axially extending stationary rim means provided on said housing means.

6. The compressor of claim 5 wherein said second support means is provided with substantially planar shoulder means which lie in a plane which is oriented substantially normally to said longitudinal axis, and wherein at least one of said key means is provided with said adjustment means and is laterally adjustably, slidably mounted on said shoulder means.

7. The compressor of claim 1 wherein at least one of said components is laterally adjustable in all directions on its support means within a lockdown plane which is oriented substantially normally to said longitudinal axis.

8. The compressor of claim 2 wherein said base means of said non-orbiting scroll is provided with substantially axially depending skirt means having axially outer first edge portions providing first support means and said keyway means are formed in said first support means, wherein said key means are mounted on second support means provided by axially outer second edge portions of substantially axially extending stationary rim means provided on said housing means, wherein said first and second edge portions are axially spaced apart, and wherein one of said key means or keyway means of at least one of said pairs is adjustable to a limited degree in all directions on its support means within a lockdown plane which is oriented substantially normally to said longitudinal axis.

9. The compressor of claim 8 wherein said key means is the adjustable element of said pair, wherein said hold-down means comprises bolt means passing generally axially through hole means formed in said key means and threaded into said housing means, and wherein said hole means is from about 0.004 in. to about 0.1 in. larger in diameter than the diameter of the shank of said bolt means.

10. The compressor of claim 2 wherein said base means of said non-orbiting scroll is provided with substantially axially depending skirt means having axially outer first edge portions providing first support means and said key means are formed said first support means, wherein said keyway means are mounted on second support means provided by axially outer second edge portions of substantially axially extending stationary rim means provided on said housing means, wherein said first and second edge portions are axially spaced apart, and wherein one of said key means or keyway means of at least one of said pairs is adjustable to a limited degree in all directions on its support means within a lockdown plane which is oriented substantially normally to said longitudinal axis.

11. The compressor of claim 10 wherein said keyway means is the adjustable component of said pair, wherein said hold-down means comprises bolt means passing generally axially through hole means formed in said keyway means and threaded into said housing means, and wherein said hole means is from about 0.004 in. to about 0.1 in. larger in diameter than the diameter of the shank of said bolt means.

12. A scroll compressor sub-assembly comprising housing means containing an axially compliant, non-orbiting scroll means having a center axis, a base means and a wrap extending axially outwardly therefrom, main bearing within and formed on said housing means and having a bore whose axis defines the longitudinal axis of said compressor, alignment means fixing the radial and angular positions of said non-orbiting scroll means on said housing means with its center axis and said longitudinal axis in alignment, said alignment means comprising a plurality of mating pairs of cooperating positioning components angularly spaced about said longitudinal axis, one component of each said pair being mounted or formed on support means provided on said housing means and the other component of each said pair being mounted or formed on said non-orbiting scroll means, at least one component of at least one said pair being radially adjustable for adjusting the contact pressure between the components of all said pairs to thereby provide an axial movement restraining force to said non-orbiting scroll means, and hold-down means locking each said radially adjustable component to its support means in an immovable position, said alignment means adapted to allow axial movement of said non-orbiting scroll only upon the development of predetermined pressures within a pressure continuum of the scroll compressor.

13. The method for setting and fixing the radial position of a non-orbiting scroll with respect to the longitudinal, axis of a scroll compressor having a housing means, comprising the steps of:

(a) establishing the longitudinal axis of said compressor by providing main crankshaft bearing means in said housing means, the axis of the bore of said bearing means providing said longitudinal axis;

(b) prior to or subsequent to step (a), providing at least two generally angularly opposed stop means on each of said housing means and said scroll, said stop means being angularly spaced from each other around said longitudinal axis, said angular spacing being designed to locate each stop means on said housing means in juxtaposition to a mating stop means on said scroll to provide at least two pairs of juxtaposed mating stop means upon placement of said scroll on said housing means in a desired operating position with respect to said longitudinal axis, at least one of said stop means on at least one of said pairs being at least radially adjustable;

(c) placing said scroll in said desired operating position relative to said longitudinal axis with said stop means of each said pair in substantial juxtaposition;

(d) moving each said adjustable stop means into pressure contact with its mating stop means to force all stop means into pressure contact with their mating stop means; and (e) locking each said adjustable stop means in a fixed position on its support means to thereby maintain said pressure contact and allow only axial motion of said scroll relative to said housing only upon the development of predetermined pressures within a pressure continuum of the scroll compressor.

14. The method of claim 13 wherein a stop means of only one of said pairs is adjustable.

15. The method of claim 13 wherein each stop means has side surface means oriented substantially radially and substantially axially of said compressor.

16. The method of claim 13 wherein said side surface means of at least one said adjustable stop means provides a generally wedge shaped block which narrows radially inwardly, and wherein its mating stop means is conversely configured.

17. The method of claim 13 wherein each said stop means has surface means lying in one or more planes which have a component oriented substantially axially of said compressor.

18. The method of claim 13 wherein prior to carrying out step (c), an orbiting scroll is placed in said housing in operative position, and wherein in step (c) said non-orbiting scroll is nested with said orbiting scroll in operative position with respect thereto.

19. The method of claim 13 wherein The force of said pressure contact is selected to provide a predetermined axial separation resistance force to said scroll.

20. The method of claim 19 wherein said resistance force is from about 100 to about 500 pounds.

* * * * *